US008267029B2

(12) United States Patent
Burnham

(10) Patent No.: US 8,267,029 B2
(45) Date of Patent: Sep. 18, 2012

(54) HATCH MECHANISM

(76) Inventor: Craig C. Burnham, Salem, MA (US)

( * ) Notice: Subject to any disclaimer, the term of this patent is extended or adjusted under 35 U.S.C. 154(b) by 0 days.

(21) Appl. No.: 12/639,810

(22) Filed: Dec. 16, 2009

(65) Prior Publication Data

US 2010/0162936 A1 Jul. 1, 2010

Related U.S. Application Data

(60) Provisional application No. 61/122,894, filed on Dec. 16, 2008.

(51) Int. Cl.
*B63B 19/14* (2006.01)

(52) U.S. Cl. ..... 114/201 R

(58) Field of Classification Search ..... 114/201 R
See application file for complete search history.

(56) References Cited

U.S. PATENT DOCUMENTS

| | | | | |
|---|---|---|---|---|
| 3,209,663 A | | 10/1965 | Baier | |
| 3,517,972 A | * | 6/1970 | Williams | 305/149 |
| 4,283,093 A | * | 8/1981 | Cline | 305/147 |
| 5,291,845 A | * | 3/1994 | Vallery | 114/203 |

* cited by examiner

*Primary Examiner* — Stephen Avila
(74) *Attorney, Agent, or Firm* — Grossman, Tucker, Perreault & Pfleger, PLLC

(57) ABSTRACT

A hatch mechanism for releasably securing a hatch to a deck of a vessel may include a latching mechanism comprising a housing extending generally outwardly from a bottom surface of the hatch. The latching mechanism may also comprise a strong back disposed within a opening in the housing and extending generally parallel to the bottom surface of the hatch. Upon application of a pressurized fluid, an actuator may be configured to bias a wedge against the opening in the housing and the strong back such that the wedge urges the strong back towards the bottom surface of the hatch. A method of releasably securing the hatch to deck may comprise providing a source of a pressurized fluid and applying the pressurized fluid to a latching mechanism to releasably secure the hatch to the deck.

21 Claims, 8 Drawing Sheets

HATCH MECHANISM

CROSS REFERENCE TO RELATED APPLICATIONS

This application claims the benefit of U.S. Provisional Application No. 61/122,894, filed Dec. 16, 2008 and entitled HATCH MECHANISM, which is fully incorporated herein by reference.

BACKGROUND

The present disclosure relates generally to hatches or manhole and hatch mechanisms, and more particularly to a hydraulically actuated hatch and hatch mechanism.

BACKGROUND

Many vessels such as, but not limited to, barges, cargo ships, oil tankers, passenger ships, ferries, and other marine vessels, may include one or more bulkheads, compartments, or the like which may be accessed through one or more hatches. While the hatches may be located in a variety of locations on the vessel, hatches may be located on the deck of the vessel. It may be desirable to releasably secure the hatches to the deck in order to prevent hatch from accidentally being displaced.

BRIEF DESCRIPTION OF THE DRAWINGS

Features and advantages of the present disclosure are set forth by the description of embodiments consistent therewith, which description should be considered in conjunction with the accompanying drawings, wherein.

DESCRIPTION

In some applications, it may be desirable to have a hatch substantially flush with or recessed from a deck in order to minimize obstructions on the deck, maximize the amount of available deck space, reduce and/or prevent damage to the hatch, minimize tripping hazards, or the like. Depending upon the application, the hatch may be exposed to the environment. As a result, it may also be desirable for the hatch to form a substantially waterproof seal with the deck in order to reduce and/or prevent water from entering and filling the bulkhead or compartment. Water in the bulkhead or compartment may reduce the cargo capacity of the vessel, damage equipment or cargo contained within the bulkhead or compartment, or damage the vessel (for example, due to corrosion and the like). Thus, it may be desirable to have a low cost, low maintenance waterproof hatch and latching mechanism that may be flush mounted.

Figure 1:
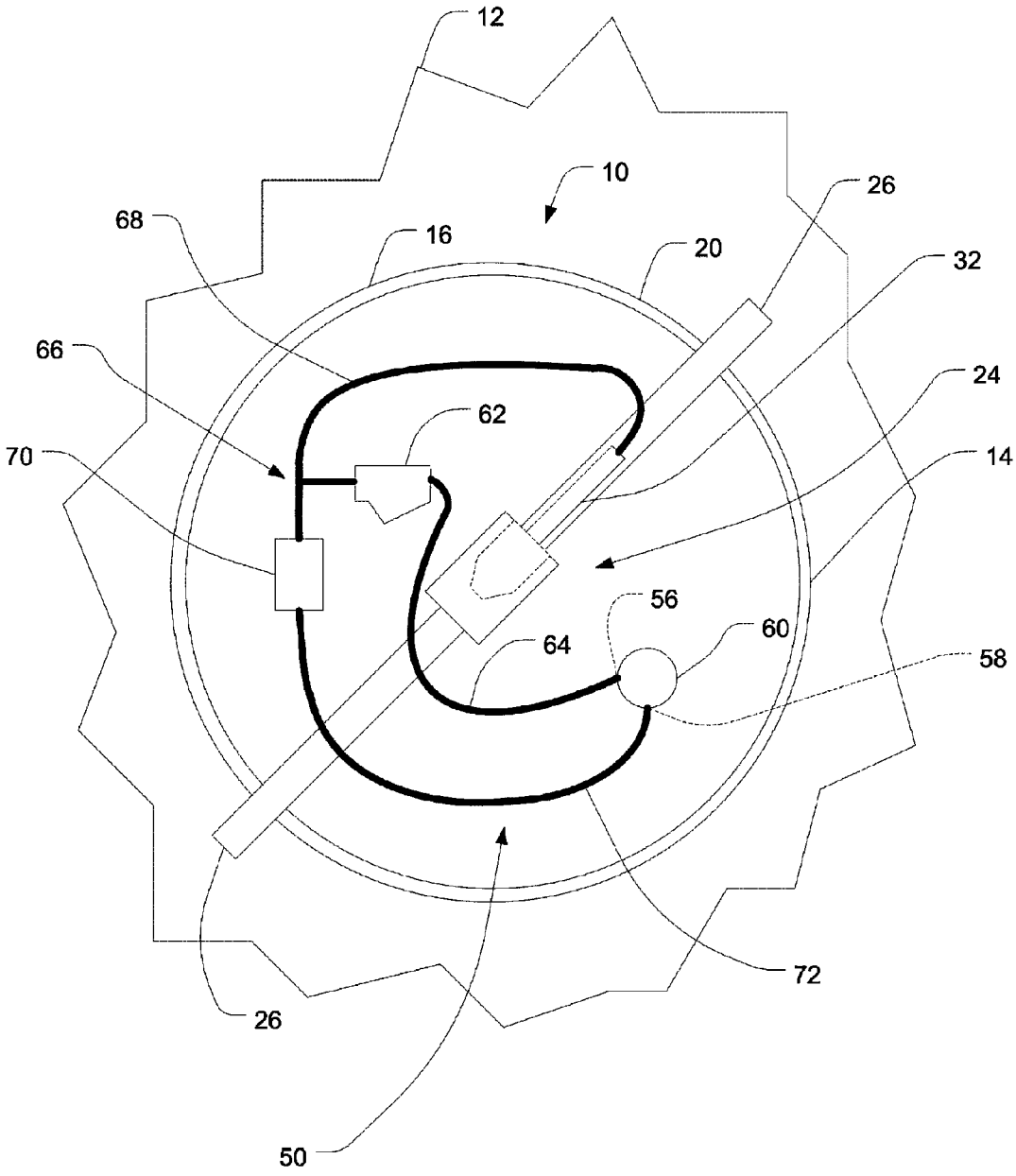
FIG. 1 is a bottom plan view of a flush mountable hatch having a hydraulically actuated latching mechanism according to the present disclosure.

Referring now to the drawings, FIG. 1 illustrates a bottom view of a hatch, seen generally at 10, which may be used with support surface 12, such as a deck or the like, defining at least a portion of a bulkhead or compartment of the type used in a vessel. For sake of clarity, the support surface 12 will generally be referred to herein as a deck 12; however, the hatch 10 may be used with support surfaces 12 other than a deck including, but not limited to, a divider, wall, hull, door, or the like.

Figure 2:
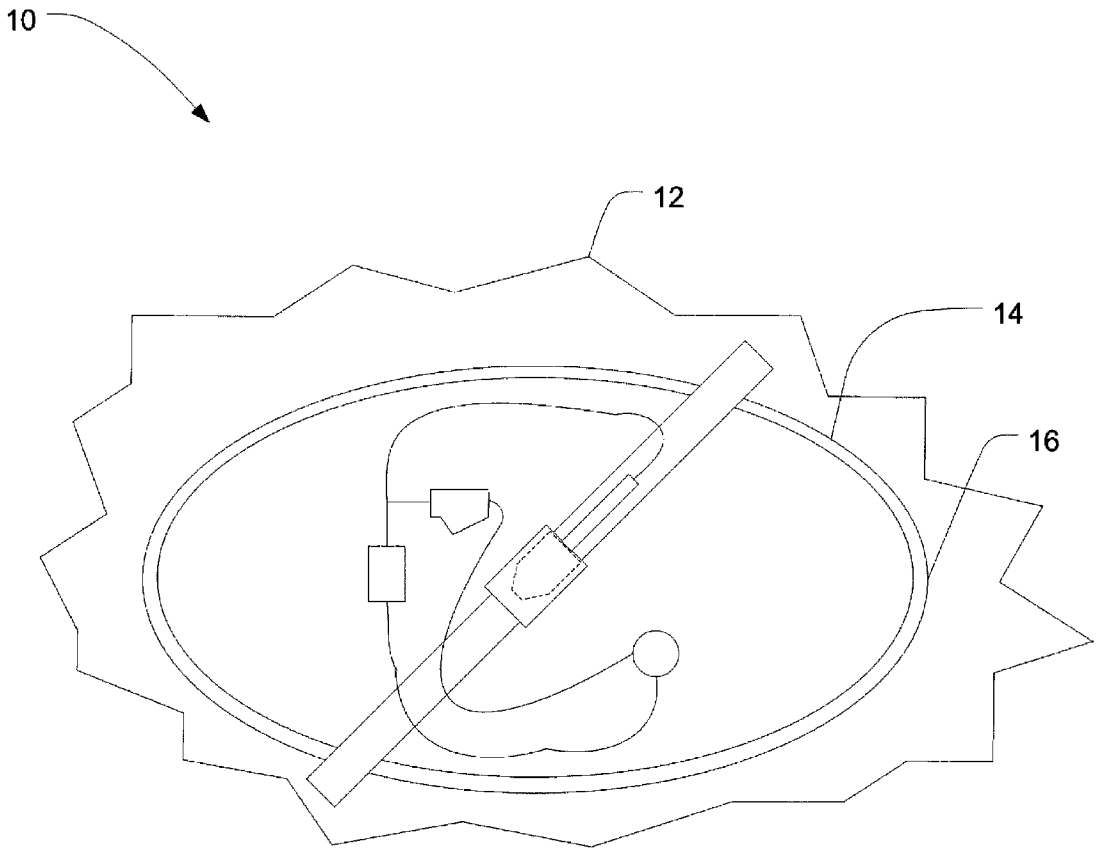
FIG. 2 is a bottom, plan view of a flush mountable hatch having a generally oval shape according to the present disclosure.

The hatch 10 may be configured to at least partially fit within an opening 14 in the deck 12. For example, the hatch 10 may have a generally circular shape as generally depicted in FIG. 1 having an outer perimeter that generally corresponds to the inner perimeter of the opening 14. The hatch 10 may also include a variety of other shapes configured to at least partially fit within an opening 14 in the deck 12 such as, but not limited to, a generally oval shape as generally depicted in FIG. 2. Other shapes for the hatch 10 are also possible depending on the intended application and the configuration of the opening 14 in the deck 12.

Figure 3A:
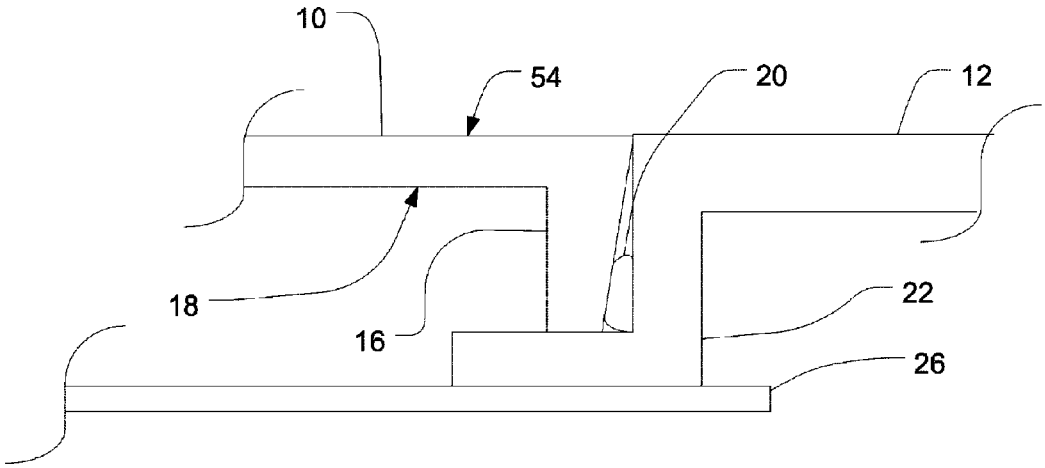
FIG. 3A is a cross-sectional, side view of one embodiment of the hatch having a seal in accordance with the present disclosure.
Figure 3B:
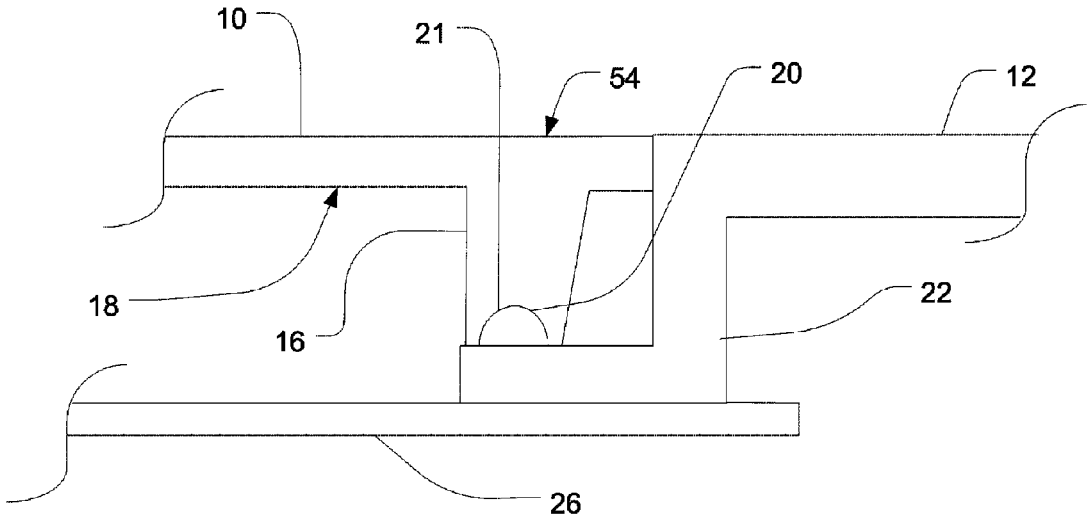
FIG. 3B is a cross-sectional, side view of another embodiment of the hatch having a seal in accordance with the present disclosure.
Figure 3C:
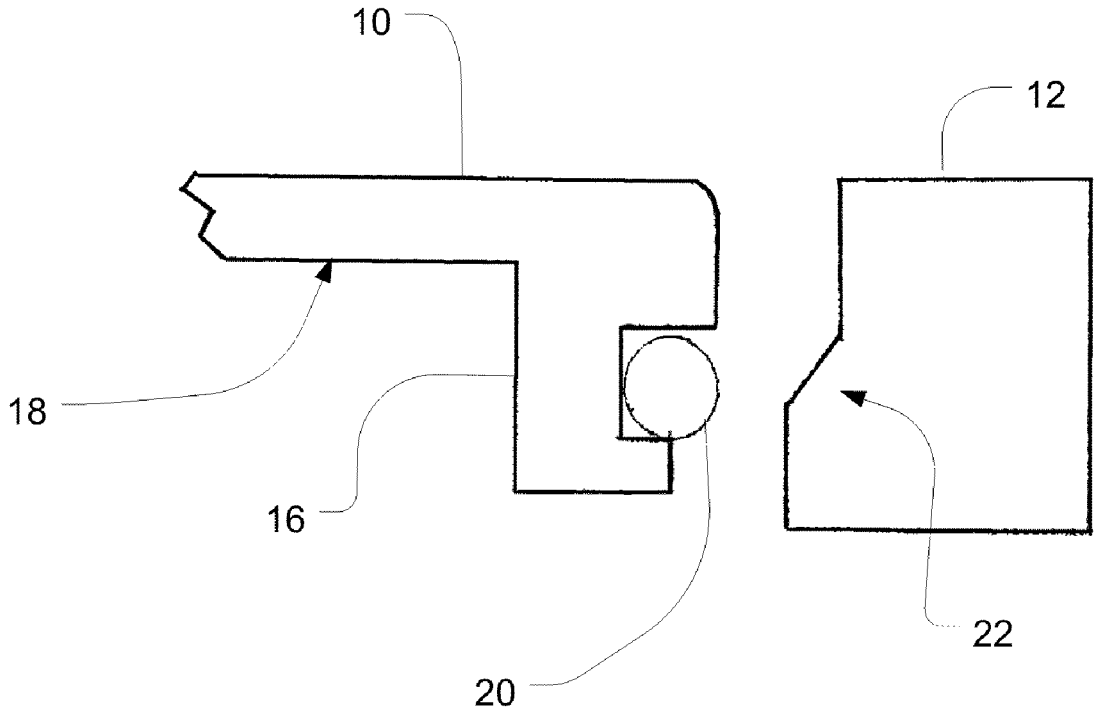
FIG. 3C is a cross-sectional, partially exploded side view of another embodiment of the hatch having a seal in accordance with the present disclosure.

The perimeter of the hatch 10 may include a protrusion or lip 16, for example as best seen in FIGS. 3A-3C, extending generally downwardly and generally away from the bottom surface 18 of the hatch 10. For example, the lip 16 may extend generally perpendicularly from the bottom surface 18 of the hatch. One or more seals 20 may be disposed about at least a portion of the perimeter of the hatch 10. The seals 20 may be configured to engage the deck 12, for example, to form a substantially water-proof seal with a flange 22 of the deck 14 (such as, but not limited to, an "L" shaped flange). For example, the seal 20 may include a compressible and/or deformable seal such as, but not limited to, an o-ring type seal, a gasket, a foam seal, or the like disposed about the perimeter of the opening 14, such as between the lip 16 and the flange 22 in the deck 12 as seen in FIGS. 3A and 3C. The seal 20 may include any deformable material such as, but not limited to, resiliently deformable material including rubbers and the like. The seal 20 may also be disposed within a groove 21 in the lip 16 as shown in FIG. 3B. The hatch 10 and opening 14 may also form a compression and/or interference connection which may not require the use of a separate seal 20.

Figure 4:
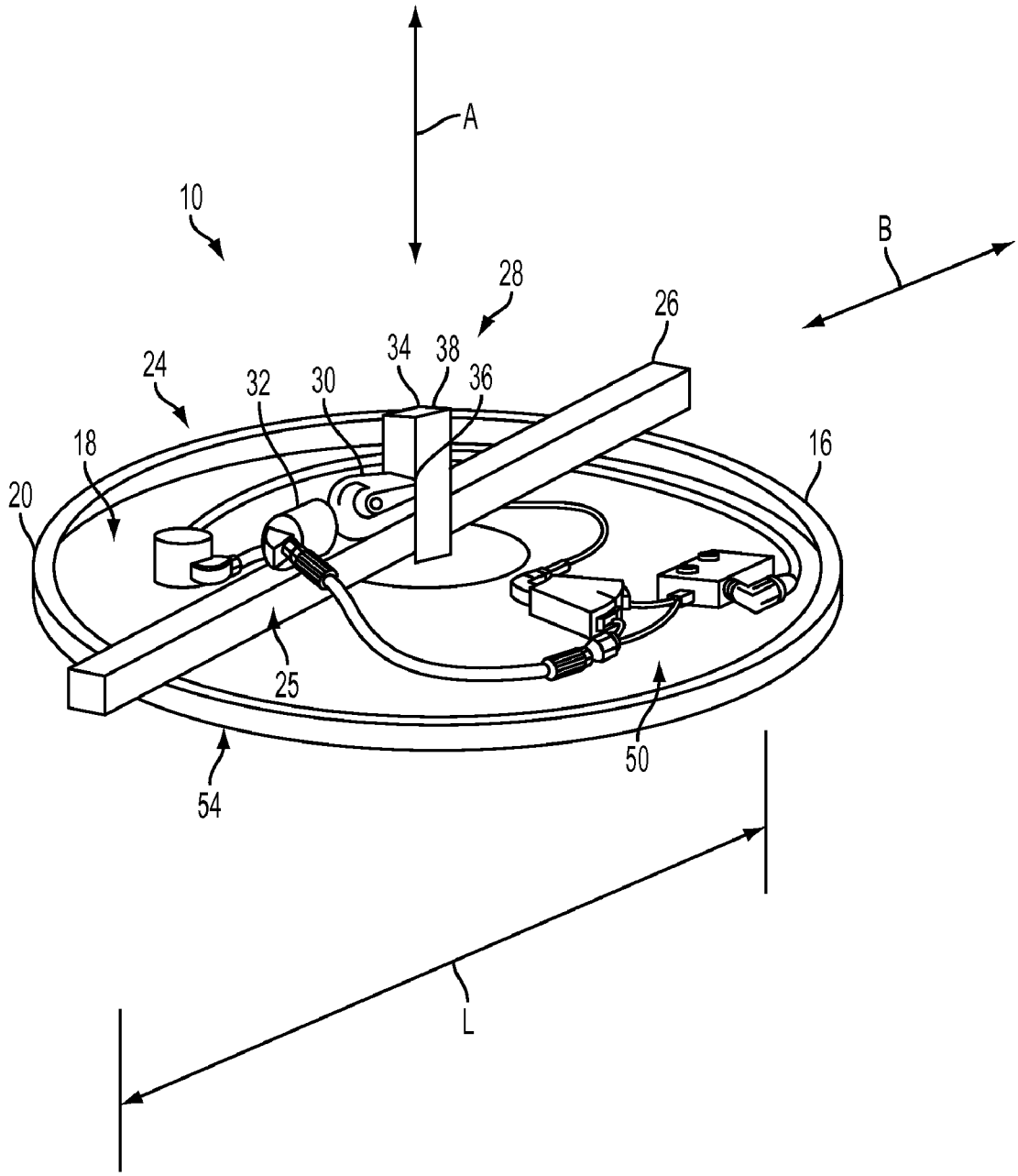
FIG. 4 is a bottom, perspective view of the hatch shown in FIG. 1.

The hatch 10, FIG. 4, may also include at least one latching mechanism 24 for releasably coupling the hatch 10 to the deck 12. The latching mechanism 24 may include one or more loading bars, beams or strong backs 26 configured to engage with at least a portion of the deck 12. The length L of the strong back 26 may vary depending on the dimensions of the hatch 10, the opening 14 in the deck 12, the configuration of the deck flange 22 (if one is present), as well as desired clamping force and is considered within the knowledge of one of ordinary skill in the art. For example, the length L of the strong back 26 may be larger than at least one cross-sectional dimension of the opening 14 in the deck 12 such that the strong back 26 may extend substantially parallel to the deck 12 and beyond the opening 14 in the deck 12 in at least one direction. According to one embodiment, the strong back 26 may have a length L greater than the diameter of the hatch 10 when the hatch 10 has a generally circular shape. The strong back 26 may also have a length L which is greater than at least one cross-sectional dimension as defined by a plane extending substantially parallel to the bottom surface 18 or top surface 54 of the hatch 10 when used hatches 10 having a non-circular shape.

The latching mechanism 24 may also include one or more actuator mechanisms 25, such as a wedge ram, for releasably urging and/or moving the strong back 26 generally in the direction of line A between a locked position (in which at least a portion of the strong back 26 engages with a portion of the deck 12 to secure the hatch 10 to the deck 12) and an unlocked position (in which the strong back 26 is substantially disengaged from the deck 12 and the hatch 10 may be removed from the deck 12) as will be explained in greater detail hereinbelow. For example, the actuator mechanism 25 may include a housing 34 extending substantially perpendicularly outwardly from the bottom surface 18 of the hatch 10. The housing 34 may include at least one opening 36 configured to at least partially receive a portion of the strong bar 26 and at least a portion of a wedge 30.

An actuator 32 may be coupled to the housing 34, for example, using one or more brackets, braces or the like and/or coupled directly to the bottom surface 18 of the hatch 10. The actuator 32 may be configured to urge the wedge 30 back and forth substantially along the direction of arrow B such that at least a portion of the wedge 30 moves within the opening 36 of the housing 34. As will be explained in greater detail hereinbelow, the actuator 32 may include a cylinder and a piston coupled to the wedge 30 which may be extended by way of a pressurized fluid such as, but not limited to, oil and/or grease. Additionally, the actuator 32 may also include a return spring or the like configured to retract the piston into the cylinder for moving/urging the wedge 30 to the unlocked position.

Figure 5:
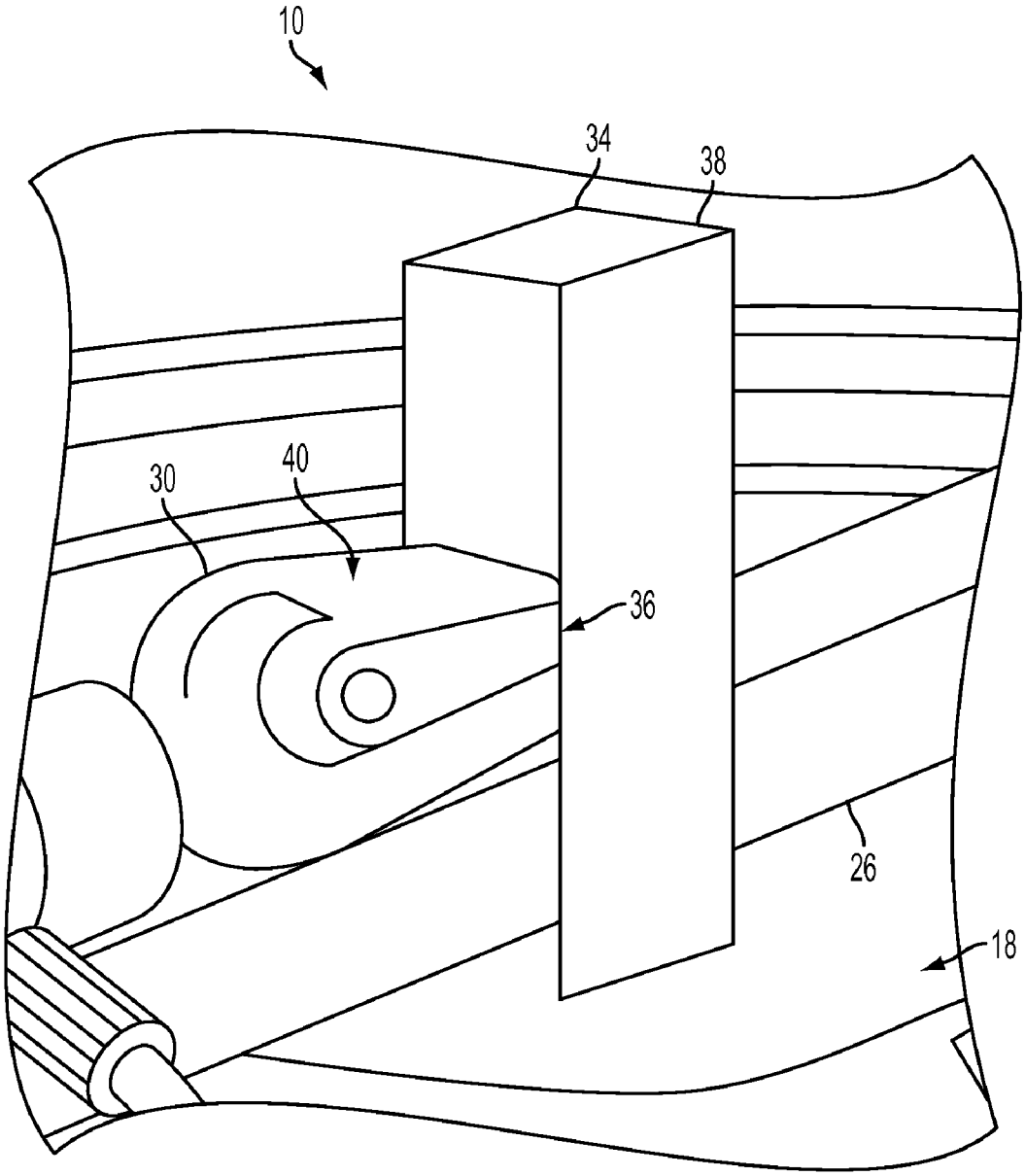
FIG. 5 is a close-up of the housing and wedge shown in FIG. 4 in accordance with the present disclosure.

As mentioned above, a portion of the strong bar 26 and a portion of the wedge 30 may be disposed within the opening 36 of the housing 34. For example, a portion of the strong bar 26 may be disposed within the housing 34 proximate the bottom surface 18 of the hatch 10 and a portion of the wedge 30 may be configured to be disposed within the opening 36 between the strong bar 26 and a distal end 38 of the housing 34. The wedge 30 (as best seen in FIG. 5) may have at least one generally tapered surface 40 configured to engage with at least one a portion of the opening 36 in the housing 34 and/or at least a portion of the strong bar 26 as the wedge 30 is moved with respect to the opening 36. For example, as the actuator 32 urges the wedge 30 into the opening 36 in the housing 34 (e.g., by applying pressurized grease to the actuator 32), the wedge 30 may engage at least part of the opening 36 of the housing 34 and the strong bar 26 and the increasing dimensions of the tapered surface 40 may be configured to urge the strong bar 26 towards the bottom surface 18 of the hatch 10. The overall taper and thickness of the wedge 30 may depend upon the desired amount of movement of the strong bar 26 and/or the wedge 30 along the arrow A, the dimensions of the strong bar 26, the opening 36 of the housing 34 and the flange 22, as well as the desired amount of clamping force of the latching mechanism 24.

Figure 6:
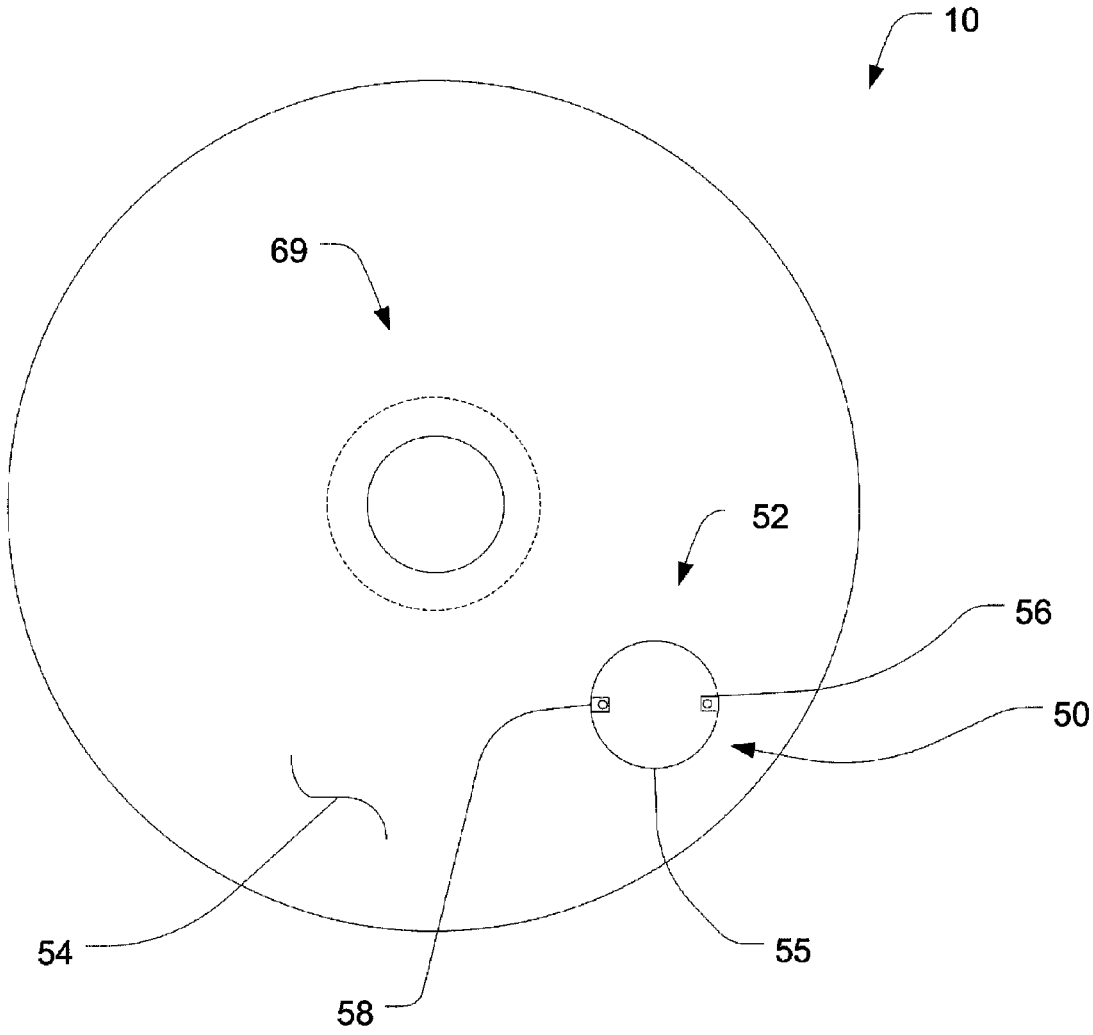
FIG. 6 is a top plan view of the hatch shown in FIG. 1 in accordance with the present disclosure.

The latching mechanism 24 may also include a control mechanism 50, FIGS. 1, 4 and 6, configured to allow a user to urge the latching mechanism 24 between the locked and unlocked positions. As best seen in FIG. 6, the control mechanism 50 may include at least one coupler 52 such as, but not limited to, a zerk grease fitting, disposed on a top surface 54 of the hatch 10 (e.g., the surface of the hatch 10 which is exposed to the environment). The coupler 52 may be provided in one or more recesses 55 disposed about the top surface 54 of the hatch 10. The recesses 55 may optionally include a cover or lid (not shown) configured to protect the couplers 52.

The couplers 52 of the control mechanism 50 may include a first zerk grease fitting 56 configured to supply hydraulic (e.g., grease) pressure to the actuator mechanism 25 (e.g., the actuator 32) and a second zerk grease fitting 58 configured to release the hydraulic (e.g., grease) pressure from the actuator mechanism 25 (e.g., the actuator 32). Alternatively, a single coupler 52 may be provided with a switch (not shown) allowing the user to selectively supply or release the hydraulic pressure to the actuator mechanism 25. The hatch 10 may also be provided with one or more handles 69, for example a recessed handhold, on the top surface 54 for facilitating handling the hatch 10.

Referring back to FIG. 1, the first and the second grease fittings 56, 58 may be disposed within a housing 60 coupled to the bottom surface 18 of the hatch 10. The first grease fitting 56 may be coupled to a check valve 62, for example by way of one or more hydraulic lines 64. The check valve 62 may be configured to allow fluid to flow towards the actuator 32 (for example, through a "T" connection 66 and hydraulic line 68) while substantially preventing the flow of fluid back towards the first grease fitting 56.

To secure the hatch 10 to the deck 12, a source of pressurized fluid (for example, a grease gun or the like) may be coupled to the first grease fitting 56 to provide hydraulic pressure to the actuator 32. The hydraulic pressure provided by the grease may cause the actuator 32 to urge the wedge 30 into the opening 36 in the housing 34, which in turn may urge the strong bar 26 towards the bottom surface 18 of the hatch 10 and against a portion of the deck 12 to secure the hatch 10 to the deck 12. As the strong bar 26 engages the deck 12, the hatch 10 may be secured in place.

The second grease fitting 58 may be coupled to a pilot release valve 70 to release the hydraulic pressure provided to the actuator 32, for example by way of a hydraulic line 72. The pilot release valve 70 may be fluidly coupled to the actuator 32, for example by way of the "T" connection 66 and hydraulic line 66.

To release the hatch 10, a source of pressurized fluid (for example, a grease gun) may be coupled to the second grease fitting 48 to provide hydraulic pressure to the pilot release valve 70. Once the hydraulic pressure supplied by second grease fitting 58 exceeds a predetermined threshold, the pilot release valve 70 opens allowing the pressurized grease to be released from the actuator 32. Optionally, a catch container (not shown) may be coupled to the release port of the pilot release valve 70 to contain the grease released during the venting process. A return spring (not shown) coupled to the actuator 32 may cause the actuator 32 to at least partially retract thereby causing the wedge 30 to be at least partially retracted from the opening 36 in the housing 34, thereby allowing the strong back 26 to disengage from the deck 12. As mentioned above, that actuator 32 may also include a two-way actuator and hydraulic pressure may also be provided to the two-way actuator 32 to retract the actuator and wedge 30.

Figure 7:
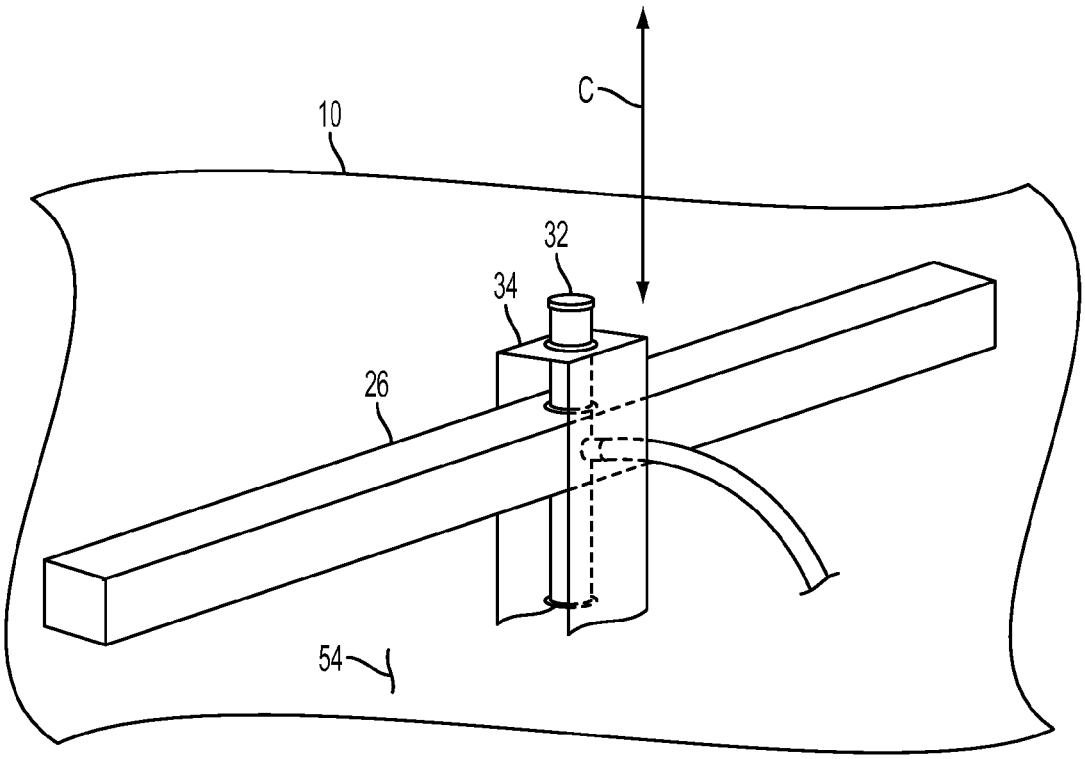
FIG. 7 is a bottom, plan partial view of another embodiment of a hatch in accordance with the present disclosure.

According to another embodiment, the hatch 10 may comprise an actuator 32 including a two-way cylinder and piston in which pressure may both extend and retract the actuator 32, thus moving the strong bar 26 into the secured (i.e., locked) and unsecured (unlocked) positions. One embodiment of a hatch 10 comprising a two-way actuator 32 consistent with the present disclosure is generally illustrated in FIG. 7. As shown, the hatch 10 may include a two-way actuator 32 coupled to a pilot valve (not shown), for example, as described herein. The two-way actuator 32 may be configured to move/urge the strong bar 26 generally along the direction of arrow C, for example generally perpendicular to the bottom surface 18 of the hatch 10. Upon application of pressure to a first side of the two-way actuator 32, the two-way actuator 32 may move the strong bar 26 generally towards the bottom surface 18 of the hatch 10 and therefore against the deck 12.

To release the hatch, the pressure may be released from the first side of the two-way actuator 32 and optionally applied to a second side of the two-way actuator 32, thus urging the strong bar 26 generally away from the bottom surface 18 of the hatch 10 and the deck 12. As illustrated in FIG. 7, the use of a two-way actuator 32 may be used without a wedge 30. Alternatively, a two-way actuator 32 may also be used with a wedge 30.

In light of the above, the latching mechanism 24 as described herein may be easily secured to and released from the deck 12 using only a grease gun or the like and may provide a substantially water tight seal with the deck 12 that may be flush mounted. For example, the latching mechanism 24 may be capable of providing approximately 1000 lbs of sealing pressure using a common grease gun. Additionally, since the only openings in the hatch 10 are provided for the coupler 52, the risk of water leakage is substantially reduced compared to the other quick opening latching mechanisms, for example, which utilize a "T" style bolt.

According to at least one embodiment, the present disclosure may feature an apparatus comprising a hatch including a top and a bottom surface and at least one latching mechanism. The latching mechanism may comprise at least one housing, at least one strong back and at least one actuator. The housing may extend generally outwardly from the bottom surface of the hatch and may include at least one opening. The strong back may extend generally parallel to the bottom surface of the hatch. At least a portion of the strong back may be configured to be at least partially received within the opening in the housing. The actuator may be configured to bias the strong back towards the bottom surface of the hatch upon application of a source of hydraulic pressure to the actuator.

According to another embodiment, the present disclosure may feature an latching mechanism for a hatch comprising a top and a bottom surface. The latching mechanism may comprise at least one housing, at least one strong back and at least one actuator. The housing may be configured to extend generally outwardly from the bottom surface of the hatch and may include at least one opening. The strong back may be configured to extend generally along the bottom surface of the hatch and may include a portion configured to be at least partially received within the opening in the housing. The actuator may be configured to bias the wedge against the opening in the housing and the strong back such that the wedge urges the strong back towards the bottom surface of the hatch.

According to yet another embodiment, the present disclosure may feature a method of releasably securing a hatch to deck. The method may comprise providing a source of a pressurized fluid (for example, from a portable grease gun) and applying the pressurized fluid to a latching mechanism to releasably secure the hatch to the deck.

As mentioned above, the present disclosure is not intended to be limited to a system or method which must satisfy one or more of any stated or implied objects or features and should not be limited to the preferred, exemplary, or primary embodiment(s) described herein. The foregoing description of a preferred embodiment of the present disclosure has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the present disclosure and its practical application to thereby enable one of ordinary skill in the art to utilize the present disclosure in various embodiments and with various modifications as is suited to the particular use contemplated. All such modifications and variations are within the scope of the present disclosure.

What is claimed is:

1. An apparatus comprising:

a hatch comprising a top and a bottom surface;

at least one latching mechanism, said latching mechanism comprising:

at least one housing extending generally outwardly from said bottom surface of said hatch, said at least one housing comprising at least one opening;

at least one strong back extending generally parallel to said bottom surface, wherein at least a portion of said strong back is configured to be at least partially received within said opening in said at least one housing;

at least one actuator; and a control mechanism configured to selectively either supply hydraulic pressure to said actuator to urge said strong back towards said bottom surface of said hatch or selectively cause said actuator to urge said strong back away from said bottom surface of said hatch when said control mechanism is coupled to a source of hydraulic pressure;

a recess disposed in said top surface of said hatch;

a lid configured to generally cover said recess; and at least one coupler, configured to be coupled to said supply of hydraulic pressure, disposed in said recess.

2. The apparatus of claim 1, further comprising:

at least one wedge, coupled to said actuator, configured to be at least partially received within said opening in said at least one housing and configured to engage at least a portion of said strong back, wherein said at least one actuator is configured to bias said at least one wedge against said opening in said housing and said at least one strong back such that said at least one wedge urges said at least one strong back towards said bottom surface of said hatch.

3. The apparatus of claim 1, further comprising a first zerk grease fitting configured to supply said source of hydraulic pressure to said actuator and a second zerk grease fitting configured to release said source of hydraulic pressure from said actuator.

4. The apparatus of claim 3 wherein said control mechanism further comprises at least one check valve disposed between said first zerk grease fitting and said actuator, said at least one check valve configured to allow fluid to only flow from said first zerk grease fitting towards said actuator.

5. The apparatus of claim 3, wherein said control mechanism further comprises at least one pilot release valve disposed between said second zerk grease fitting and said actuator, said at least one pilot release valve configured to release said hydraulic pressure supplied to said at least one actuator when a hydraulic pressure provided by said second zerk grease fitting exceeds a predetermined threshold.

6. The apparatus of claim 1, wherein said actuator comprises a hydraulic cylinder and piston.

7. The apparatus of claim 6, wherein said actuator further comprises a spring.

8. An latching mechanism for a hatch comprising a top and a bottom surface, said latching mechanism comprising:

at least one housing configured to extend generally outwardly from said bottom surface of said hatch, said at least one housing comprising at least one opening;

at least one strong back configured to extend generally along said bottom surface of said hatch, wherein at least a portion of said strong back is configured to be at least partially received within said opening in said at least one housing;

at least one;

a control mechanism configured to selectively either supply hydraulic pressure to said actuator to urge said strong back towards said bottom surface of said hatch or selectively cause said actuator to urge said strong back away from said bottom surface of said hatch when said control mechanism is coupled to a source of hydraulic pressure; and at least one wedge, coupled to said actuator, configured to be at least partially received within said opening in said at least one housing and configured to engage at least a portion of said strong back, wherein said at least one actuator is configured to bias said at least one wedge against said opening in said housing and said at least one strong back such that said at least one wedge urges said at least one strong back towards said bottom surface of said hatch.

9. The latching mechanism of claim 8 further comprising a first zerk grease fitting configured to supply said source of hydraulic pressure to said actuator and a second zerk grease fitting configured to release said source of hydraulic pressure from said actuator.

10. The latching mechanism of claim 9, wherein said control mechanism further comprises at least one check valve disposed between said first zerk grease fitting and said actuator, said at least one check valve configured to allow fluid to only flow from said first zerk grease fitting towards said actuator.

11. The latching mechanism of claim 9, wherein said control mechanism further comprises at least one pilot release valve disposed between said second zerk grease fitting and said actuator, said at least one pilot release valve configured to release said hydraulic pressure supplied to said at least one actuator when a hydraulic pressure provided by said second zerk grease fitting exceeds a predetermined threshold.

12. A method of releasably securing a hatch to deck, said method comprising:

providing a source of a pressurized fluid;

applying said pressurized fluid to a latching mechanism to releasably secure said hatch to said deck; and applying a release pressure to release said pressurized grease supplied to said at least one actuator to unlatch said hatch;

wherein said release pressure is applied to a pilot release valve to release said pressurized grease supplied to said at least one actuator.

13. The method of claim 12, wherein applying said pressurized fluid to said latching mechanism comprises coupling a source of pressurized grease to a fitting disposed on said hatch and supplying said pressurized grease to said latching mechanism.

14. The method of claim 13, wherein said pressurized grease is provided to at least one actuator of said latching mechanism, said at least one actuator configured to urge a strong back generally against a bottom surface of said deck to secure said hatch to said deck.

15. The method of claim 14, further comprises biasing, by way of said pressurized grease provided to said at least one actuator, at least one wedge against said strong back and a housing coupled to said bottom surface of said hatch.

16. The latching mechanism of claim 8, wherein said actuator comprises a hydraulic cylinder and piston.

17. The latching mechanism of claim 8, wherein said actuator further comprises a spring.

18. An apparatus comprising:

a hatch comprising a top and a bottom surface;

at least one latching mechanism, said latching mechanism comprising:

at least one housing extending generally outwardly from said bottom surface of said hatch, said at least one housing comprising at least one opening;

at least one strong back extending generally parallel to said bottom surface, wherein at least a portion of said strong back is configured to be at least partially received within said opening in said at least one housing;

at least one actuator; and a control mechanism configured to selectively either supply hydraulic pressure to said actuator to urge said strong back towards said bottom surface of said hatch or selectively cause said actuator to urge said strong back away from said bottom surface of said hatch when said control mechanism is coupled to a source of hydraulic pressure; and a first zerk grease fitting configured to supply said source of hydraulic pressure to said actuator and a second zerk grease fitting configured to release said source of hydraulic pressure from said actuator.

19. The apparatus of claim 18 wherein said control mechanism further comprises at least one check valve disposed between said first zerk grease fitting and said actuator, said at least one check valve configured to allow fluid to only flow from said first zerk grease fitting towards said actuator.

20. The apparatus of claim 18, wherein said control mechanism further comprises at least one pilot release valve disposed between said second zerk grease fitting and said actuator, said at least one pilot release valve configured to release said hydraulic pressure supplied to said at least one actuator when a hydraulic pressure provided by said second zerk grease fitting exceeds a predetermined threshold.

21. An apparatus comprising:

a hatch comprising a top and a bottom surface;

at least one latching mechanism, said latching mechanism comprising:

at least one housing extending generally outwardly from said bottom surface of said hatch, said at least one housing comprising at least one opening;

at least one strong back extending generally parallel to said bottom surface, wherein at least a portion of said strong back is configured to be at least partially received within said opening in said at least one housing;

at least one actuator; and a control mechanism configured to selectively either supply hydraulic pressure to said actuator to urge said strong back towards said bottom surface of said hatch or selectively cause said actuator to urge said strong back away from said bottom surface of said hatch when said control mechanism is coupled to a source of hydraulic pressure; and at least one wedge, coupled to said actuator, configured to be at least partially received within said opening in said at least one housing and configured to engage at least a portion of said strong back, wherein said at least one actuator is configured to bias said at least one wedge against said opening in said housing and said at least one strong back such that said at least one wedge urges said at least one strong back towards said bottom surface of said hatch.

* * * * *